US010427025B2

(12) United States Patent
Greenfield

(10) Patent No.: US 10,427,025 B2
(45) Date of Patent: Oct. 1, 2019

(54) SKI TOTE

(71) Applicant: Brian Greenfield, Quebec (CA)

(72) Inventor: Brian Greenfield, Quebec (CA)

(73) Assignee: Brian Greenfield, Quebec (CA)

( * ) Notice: Subject to any disclaimer, the term of this patent is extended or adjusted under 35 U.S.C. 154(b) by 0 days.

(21) Appl. No.: 15/840,390

(22) Filed: Dec. 13, 2017

(65) Prior Publication Data

US 2019/0176018 A1 Jun. 13, 2019

(51) Int. Cl.
*A63C 11/02* (2006.01)
*A45F 3/14* (2006.01)

(52) U.S. Cl.
CPC ..... *A63C 11/025* (2013.01); *A45F 3/14* (2013.01); *A45F 2003/142* (2013.01); *A45F 2003/146* (2013.01)

(58) Field of Classification Search
CPC ..... A63C 11/009; A63C 11/025; A45F 3/14; A45F 2003/142; A45F 2003/146; A45F 2003/148
USPC ..... 294/147, 150, 151, 165; 224/917
See application file for complete search history.

(56) References Cited

U.S. PATENT DOCUMENTS 4,055,287 A * 10/1977 Champenois, Jr. .. A63C 11/027 150/154
4,127,223 A * 11/1978 Uchin ..... A45F 5/00 224/250
4,463,885 A * 8/1984 Ball ..... A63C 11/025 224/250
4,705,281 A * 11/1987 Spinas ..... A63C 11/026 224/917
4,852,931 A * 8/1989 Ferdi ..... A63C 11/025 224/917
5,238,162 A * 8/1993 LaCivita ..... A45F 3/14 206/315.9
5,318,209 A * 6/1994 Rader ..... A45F 3/14 224/250
5,540,364 A * 7/1996 Krieger ..... A45F 3/08 224/153
5,603,545 A * 2/1997 Benson ..... A45F 3/14 224/250
5,611,588 A * 3/1997 Mencel ..... A63C 11/02 280/814
5,647,522 A * 7/1997 Routh ..... A45F 3/04 224/250
5,746,361 A * 5/1998 Johnson ..... A45F 3/14 224/245
D403,162 S * 12/1998 Williams ..... D3/327
5,915,609 A * 6/1999 Diakoulas ..... A45F 3/14 224/625
6,457,762 B1 * 10/2002 Garutti ..... A63C 11/006 224/257
6,908,131 B2 * 6/2005 Main ..... A61G 7/1023 294/150

(Continued)

FOREIGN PATENT DOCUMENTS

DE 295 09 809 * 10/1995
FR 2799351 A1 * 4/2001 ..... A45F 3/14

*Primary Examiner* — Dean J Kramer
(74) *Attorney, Agent, or Firm* — Leason Ellis LLP

(57) ABSTRACT

A ski tote is formed with a short strap having a snap clasp fastened to respective ends thereof. A long strap is fastened to the short strap just inside of the clasp parts. The short strap can be placed about a pair of skis and locked there with the clasp. The long strap can be used for carrying the skis.

13 Claims, 5 Drawing Sheets

(56) References Cited

U.S. PATENT DOCUMENTS

| | | | | |
|---|---|---|---|---|
| 8,616,600 | B2 * | 12/2013 | Owen | A63C 11/025 224/917 |
| 9,498,071 | B2 * | 11/2016 | Mossman | A45F 3/12 |
| 2004/0200869 | A1 * | 10/2004 | Toleman | A63C 11/009 224/257 |
| 2007/0080184 | A1 * | 4/2007 | Cowen | A45F 3/14 224/160 |
| 2011/0174857 | A1 * | 7/2011 | King | A45F 3/14 224/602 |

* cited by examiner

SKI TOTE

FIELD OF THE INVENTION

The present invention relates generally to apparatus for making it easier to carry skis and, more particularly, to arrangements of cloth and plastic materials, e.g., straps and a snap clasp, that facilitate the carrying of skis.

BACKGROUND OF THE INVENTION

A set of skis is a pair of narrow strips of wood, metal, or plastic curving upward in front that are used especially for gliding over snow. They can range in length from 2 or 3 feet for children's skis to over 6 feet for adults and professionals. In recreational skiing it is often necessary for the participant to carry the skis for several hundred yards to get from transportation to the ski slopes. If an adult is skiing with one or more children, they may have to carry more than one set of skis. Because of their shape, it is often awkward to carry skis. While they don't have excessive weight, they can weigh over ten pounds.

Conventionally, skis have bindings that extend from their top surface which allow ski boot to be attached to the skis. Thus, skis are typically carried over the shoulder with the bottom surfaces of the skis in contact with each other and arranged parallel to each other. However, because of their length, they tend to splay, so that they are no longer parallel and are even more difficult to carry. One way the splaying has been addressed in the prior art is to place elastic bands around the two skis at both the front and rear.

Carrying skis over the shoulder can become difficult because of the pressure on the top of the shoulder. Also, at least one arm is needed to balance the skis on the shoulder. Thus, devices have been proposed in the past to address this problem. One popular technique is to use a back pack and to fasten one ski on each side. This leaves the user's hands free and the weight is distributed over the user's back through the back pack. However, fastening the skis to the back pack can be complicated, especially at low temperatures when the user is wearing ski gloves. Also, fastening and unfastening the skis can be time-consuming. More importantly, only a single pair of skis can typically fastened to the back pack.

Another approach from the prior art is to use a set of straps. One strap is used to bind together the skis at the front and a second strap is used to bind the skis at their rear end. Then a third strap connects the first and second straps and acts as a handle. In order to deal with the problem of manipulating the straps at cold temperatures, they are typically provided with Velcro® materials to secure the straps about the skis. However, because of the weight of the skis, it is often necessary to secure the strap with several folds of Velcro® material. In one prior art device, the user must pass a Velcro® section through a loop and fasten it back on itself. In cold weather even this looping process can be difficult with ski gloves on. Further, Velcro® material can be relatively expensive.

With the strap design it is necessary to connect the first strap at one end of the pair of skis and the second strap at the other end. This may involve holding the skis vertically while a strap is secured and then either bending over to reach the other end or tuning the skis over. This complicates the attachment procedure and causes delays. This is especially a problem when an adult is dealing with his own skis as well as the skis of a couple of children.

Thus, it would be advantageous if there were an inexpensive device that could be fastened to skis easily and quickly so they can be carried.

SUMMARY OF THE INVENTION

The present invention is directed to a new ski carrying device or tote that is fastened to a pair of skis in two quick motions and which allows for the skis to be carried without the use of the hands and without undue pressure on the shoulders.

The device of the present invention has a single short strap or band that can be placed about a pair of skis just behind the toe binding and fastened with a snap plastic clasp. An end of the short strap can be pulled to cause a snug fit around the skis. A long strap is attached to both ends of the short strap. It can be slung over the shoulder and used to carry the skis with one hand. Alternatively, the user's arm can be passed through the loop formed by the long strap and the skis can be carried without the need to use the hands.

BRIEF DESCRIPTION OF THE DRAWINGS

The foregoing and other objects and advantages of the present invention will become more apparent when considered in connection with the following detailed description and appended drawings in which like designations denote like elements in the various views, and wherein.

DETAILED DESCRIPTION OF THE INVENTION

Figure 1:
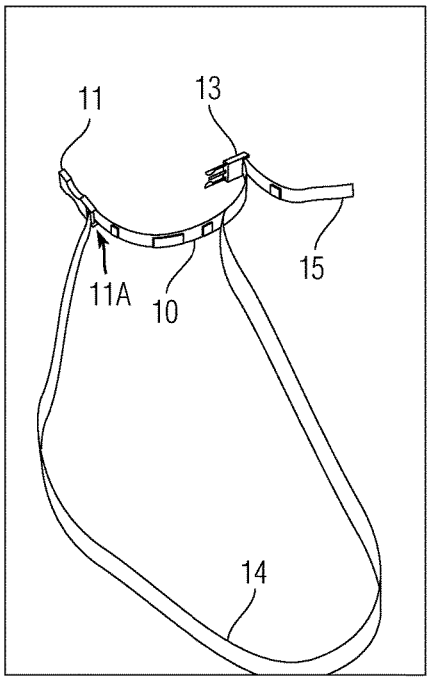
FIG. 1 shows the structure of the straps that make up the ski tote according to the present invention.
Figure 9:
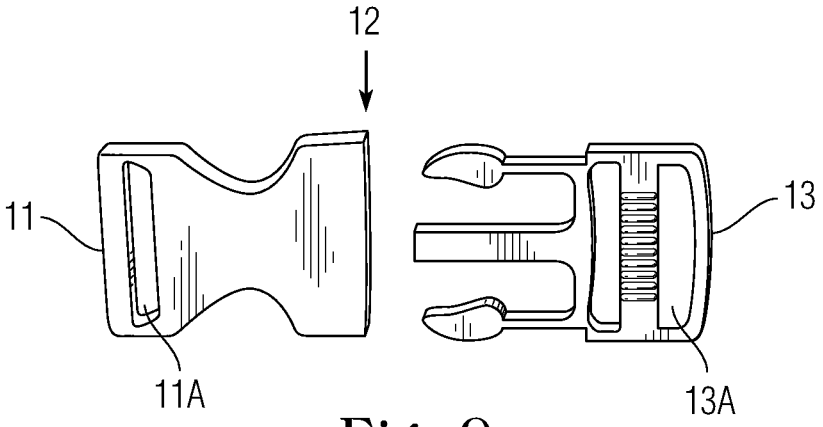
FIG. 9 is a detailed front view of the clasps of the plastic snap buckle shown in FIG. 1.

The present invention relates to a device for making is easier to carry skis. As shown in FIG. 1, the device has a short strap 10. At either end of the short strap there are the female and male elements 11, 13 of a plastic snap clasp 12. A long strap 14 is fastened to the short strap 10 just inside of and immediately adjacent to the clasp part element 11 and the other end of the long strap is fastened to the short strap just inside of the other of the clasp element 13. One end 15 of the short strap is looped through the slot 13A in the male clasp element 13. See FIG. 9. By pulling on this end the length of the short strap can be changed. As shown in FIG. 1, the end 15 only needs to be about 3 or 4 inches to provide the variation in the length of short strap 10 that is needed for skis of different thickness.

Velcro® material could be substituted for the clasp 12. However, plastic clasps are less expensive, have greater holding capacity and can be easier to use. Further, automobile or airplane seatbelt buckles, made of metal or plastics, could potentially be used for the clasp 12.

Figure 2:
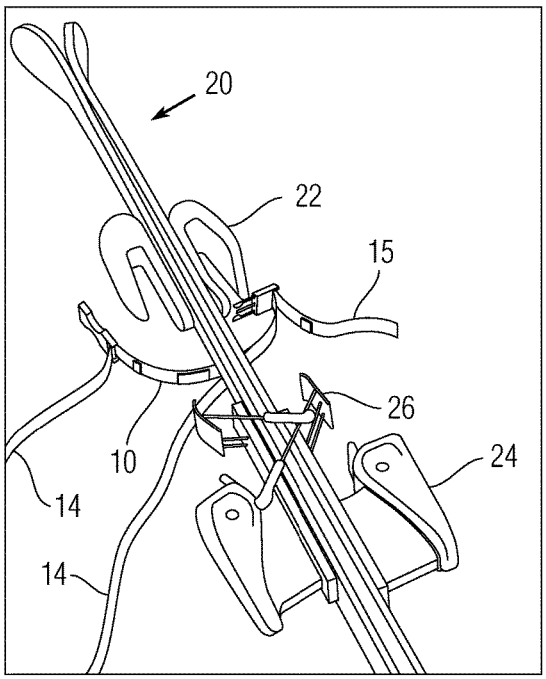
FIG. 2 shows the short strap being looped about a pair of skis just below the toe binding according to the present invention.

FIG. 2 shows a pair of short skis 20. The skis are arranged back to back in parallel with their bottom surfaces in contact with each other. The upper surfaces have toe bindings 22 and heal bindings 24, which face away from each other in the arrangement of the skis as shown. In addition, both skis are equipped with brakes 26. The present inventor observed that with the skis aligned in this way the brakes 26 interlock and prevent the back ends of the skis from splaying. Thus, it was determined that no special loop of material as used in the prior art is necessary at the rear end of the skis to prevent splaying.

Figure 3:
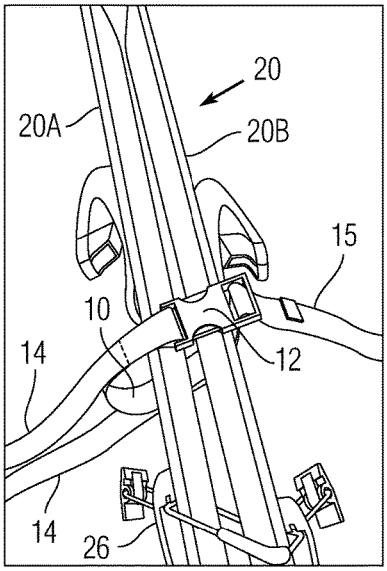
FIG. 3 shows the plastic clasp of the short strap being engage according to the present invention.

As shown in FIG. 2, the short strap 10 is looped around the skis at a location just below the toe bindings 22, assuming the skis are in a vertical position. Then the clasp 12 is fastened as shown in FIG. 3. If necessary, the end 15 is pulled further through the slot 13A so that the short strap 10 fits snuggly around the skis. This completes the attachment of the ski tote of the present invention to the skis. Thus, only one strap is passed around the skis and its clasp is locked. Except perhaps for pulling on end 15, no further action is necessary.

Figure 4A:
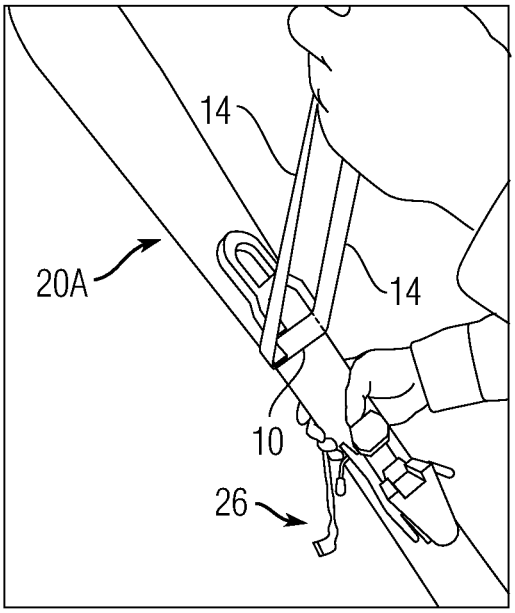
FIG. 4A shows the long strap extending from both ends of a short strap that has been snugly fit about the skis.
Figure 4B:
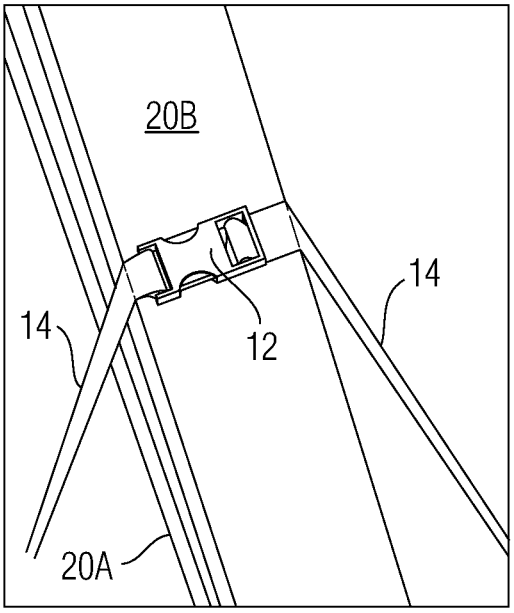
FIG. 4B shows a partial view of the opposite side with the clasp.

Note in FIG. 3 that the clasp 12 is shown arranged on the side of the pair of skis 20 for the sake of illustration. However, when tightened about the skis, the clasp 12 is on the flat outer surface of the bottom ski 20B in the arrangement, i.e., the ski to the right in FIG. 3. Because the ski 20B and clasp 12 are on the bottom, they are not shown in FIG. 4A which shows the top ski 201. However, the bottom ski and clasp can be seen in FIG. 4B, which is a partial view of the other side. Also, note in FIGS. 3 and 4 that the s 26 interlock with each other.

Figure 5:
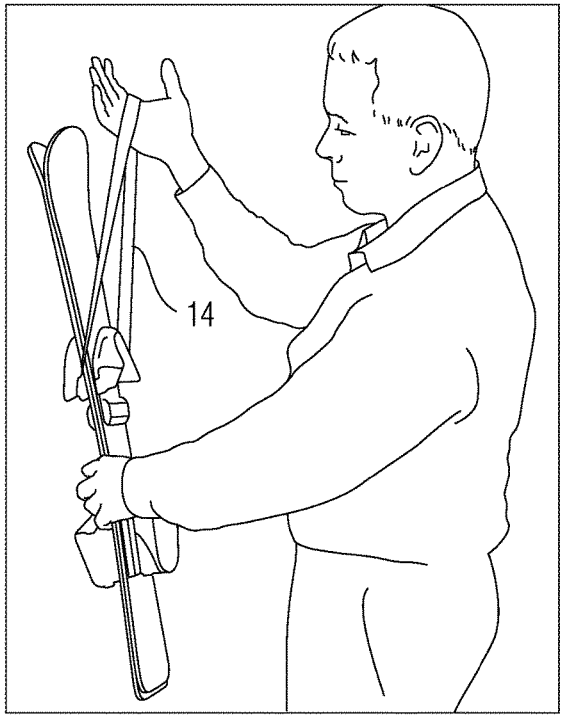
FIG. 5 is a perspective view of the long strap being slung over the shoulder of the user and held with one hand.
Figure 6:
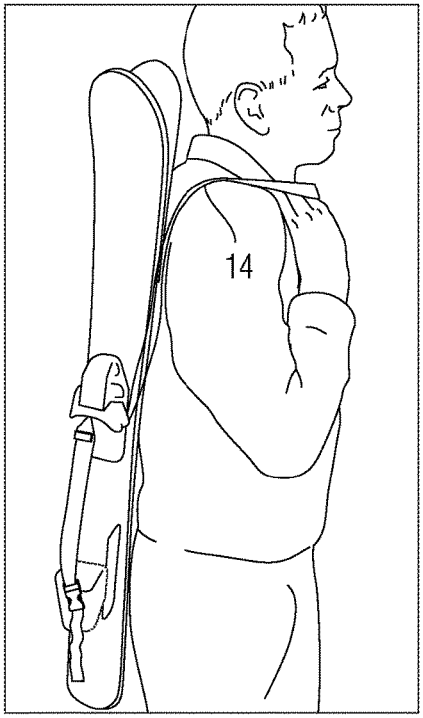
FIG. 6 is another perspective view of the long strap being slung over the shoulder of the user and held with one hand.
Figure 7:
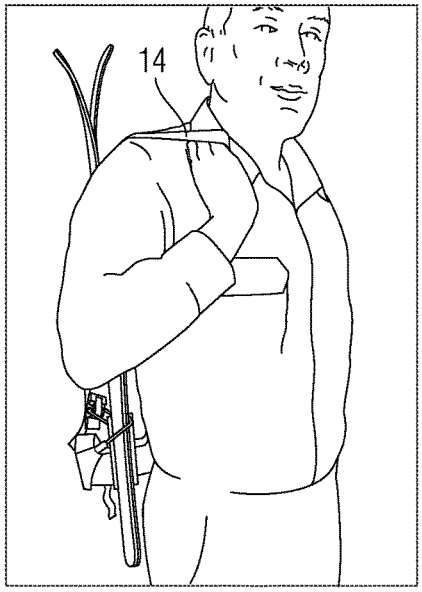
FIG. 7 is still another perspective view of the long strap being slung over the shoulder of the user and held with one hand.

Once the tote is fastened to the skis, the long strap 14 can be used to carry them. FIG. 4 shows long strap 14 attached to the ends of short strap 10 so that it has a balanced attachment. FIGS. 5-7 show the user grasping long strap 14 and slinging it over his shoulder so as to carry the pair of skis with one hand. It will be recognized, that if the user needs to carry one or more other pairs of skis, all he or she would have to do is grasp the long straps of each tote attached to those other skis. Note that the skis are generally vertical as carried in FIGS. 6 and 7. Thus, they are close to the user's body and it is not likely they will swing out during a turn and cause damage to persons or objects nearby, or to the skis. With prior art ski straps that attach both near the front and rear of the skis, grabbing the connecting carrying strap tends to place the skis in a horizontal position that makes them more difficult to maneuver within a crowd of peoples or a confined space.

Figure 8:
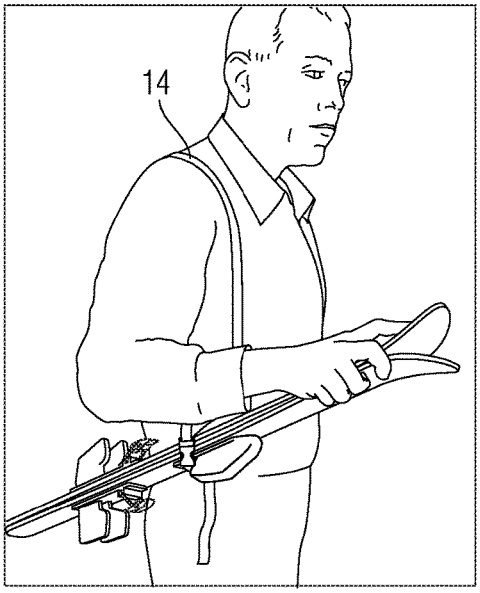
FIG. 8 is an alternative way of carrying the skis in which the arm is passed through the loop in the long strap and the skis are carried without having to be held by a hand of the user.

According to an alternative arrangement, when the user is moving in an area that is not crowded with people or there is more room for some other reason, the user's arm can be slipped through the loop formed by the long strap 14 as shown in FIG. 8. With this arrangement the user's hand is no longer holding the skis and is free to hold other items. In FIG. 8, the hand is merely resting on the tips of the skies. Thus, as the user travels with the skis, the tote can be easily switch from being hand carried to being shoulder carried and back again as conditions merit or as his or her shoulder or hand becomes tired.

Figure 10:
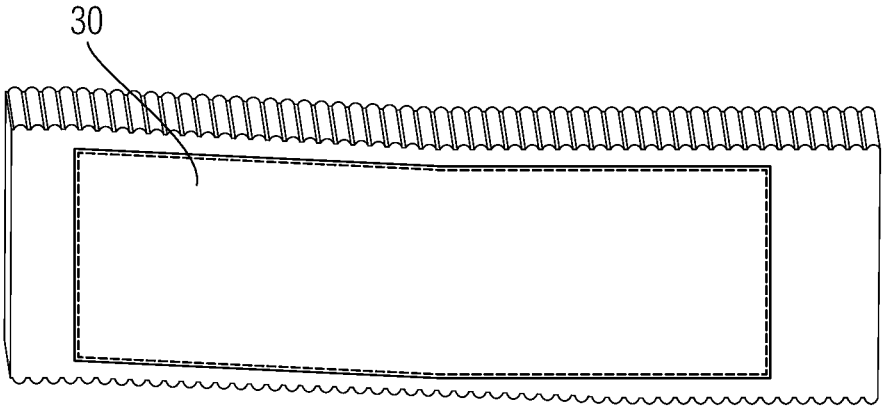
FIG. 10 is a reinforcing piece for the short strap which helps in orienting the user in the placement of the strap on the skis, stiffens the short strap and provides advertising space.

As shown in FIG. 1, the short strap 10 is made of narrow flexible material, e.g., fabric webbing. As a result, when not in use the tote can be balled up and stored in the pocket without any discomfort. Naturally, the tote can be made with straps of different material of different widths as desired to affect the cost, strength or appearance. In order to affect these factors without changing all of the material of the straps, a reinforcing piece 30 as shown in FIG. 10 can be located over the exterior part of the short strap between the connections of the long strap. In FIG. 1 it would be the side facing downward. In FIG. 4 it would be the side facing upward. It may be made of fabric material, plastic or leather.

The reinforcing piece 30 orients the user in connecting the tote to the skis. In particular, the short strap is placed about the skis so that piece 30 faces outward. Also when in the location shown in FIG. 4, it is visible to surrounding people, thus indicating to them the brand of tote. Further, the weight of the skis is applied directly to this area of the tote, so the piece 30 reinforces the short strap where it most needs it. In addition, the piece 30 provides some structure to the collection of straps, giving the impression that it is a more substantial item and enhancing the perceived value of the tote.

Figure 11:
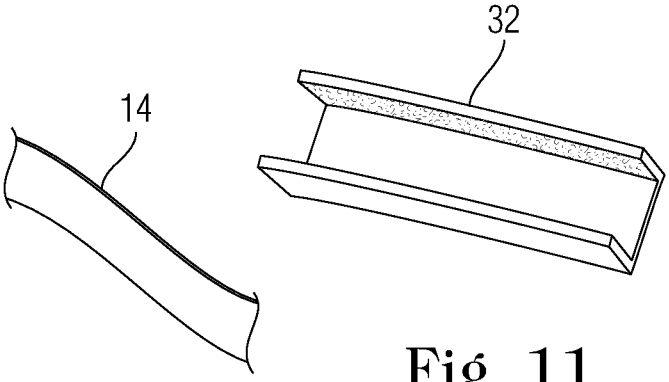
FIG. 11 shows a shoulder padding accessory for the ski tote according to the present invention separate from the long strap.
Figure 12:
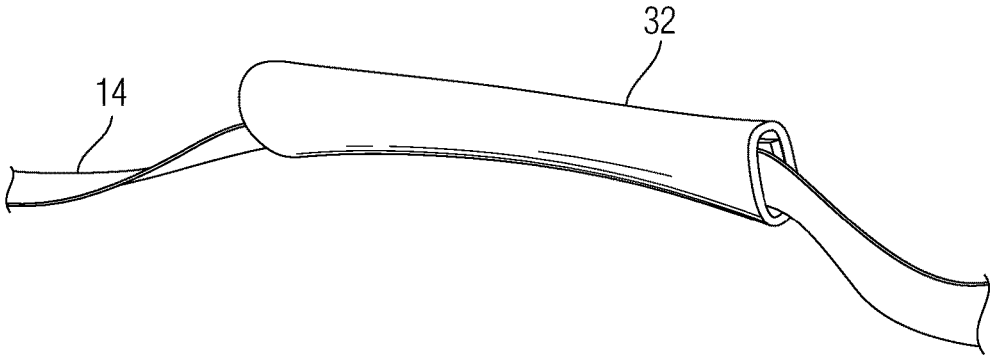
FIG. 12 show a shoulder padding accessory for the ski tote according to the present invention mounted on the long strap.

FIG. 11 shows a padded member 32 that can be used as an accessory to the tote. It is about 3 to 5 inches long so as to cover most of the hand or shoulder. It is heavily padded and has an open side. Velcro® or other fasteners can be located along the open side. Thus, the member 32 can be placed over the long strap 14 and then closed as shown in FIG. 12. When closed the padded member has sufficient space inside so that it can be slid to any convenient location along the long strap 14. For example it would be at the location of the hand in FIG. 7 and at the location of the shoulder in FIG. 8.

While the present invention has been particularly shown and described with reference to preferred embodiments thereof; it will be understood by those skilled in the art that various changes in form and details may be made therein without departing from the spirit and scope of the invention, and that the embodiments are merely illustrative of the invention, which is limited only by the appended claims. In particular, the foregoing detailed description illustrates the invention by way of example and not by way of limitation. The description enables one skilled in the art to make and use the present invention, and describes several embodiments, adaptations, variations, and method of use of the present invention.

What is claimed is:

1. A ski tote comprising:

a short strap;

a snap clasp containing at least two elements, one element being fastened to one end of the short strap and another element being fastened toward the other end of the short strap with an adjusting piece of the short strap beyond the other element; and a long strap longer than the short strap, with one end fastened to the short strap just inside of and immediately adjacent to one of the clasp elements and the other end fastened to the short strap just inside of the other of the clasp elements, the portion of the long strap between its attachments to the short strap being a continuous one-piece portion;

whereby the short strap can be placed about a pair of skis and locked there by engaging the clasp elements, the adjusting piece can be pulled to make the attachment about the skis snug and the long strap can be used for carrying the skis such that the claps elements may face away from the long strap.

2. The ski tote of claim 1, wherein the snap clasp elements comprise a male part of the clasp and a female part of the clasp.

3. The ski tote of claim 2 wherein the male and female parts are parts of a plastic buckle.

4. The ski tote of claim 1, further including a reinforcing piece attached to one side of the short strap between the snap clasp elements to strengthen the short strap and to orient it with respect to the skis.

5. The ski tote of claim 4, wherein the reinforcing piece further includes indicia on it that is visible when the short strap is fastened about a pair of skis.

6. The ski tote of claim 1, further including a shoulder padding piece mounted on the long strap.

7. The ski tote of claim 6, wherein the shoulder padding piece can be slid along the long strap.

8. The ski tote of claim 1 wherein the short strap and the long strap are made of webbing material.

9. A ski carrying method, comprising the steps of:

providing a ski tote which has a short strap with a snap clasp containing at least two elements, a first element being fastened to one end of the short strap and a second element being fastened toward the other end of the short strap with an adjusting piece of the short strap beyond the second element, and a long strap longer than the short strap with one end fastened to the short strap just inside of and immediately adjacent to the first clasp element and the other end of the long strap fastened to the short strap just inside of the second clasp element, the portion of the long strap between its attachments to the short strap being a continuous one-piece portion;

arranging the short strap of material about the pair of skis when they are located parallel to each other with their bottom surfaces in contact, said short strap being at the location of toe bindings on the skis;

locking the short strap about the skis by engaging the elements of the snap clasp;

pulling the adjusting piece through the second element to make the short strap fit snug about the skis; and grasping the long strap to carry the skis such that the claps elements may face away from the long strap.

10. The ski carrying method according to claim 9 further including the step of slinging the long strap over the shoulder of the user and holding it with one hand.

11. The ski carrying method according to claim 9 further including the step of having the user extend an arm through the loop formed by the long strap and placing the loop on the user's shoulder.

12. The ski carrying method of claim 9 wherein the ski tote further includes a reinforcement piece on one side of the short strap to orient the user during the arranging step to place the short strap about the skis, so the reinforcement piece is facing away from the skis.

13. The ski carrying method of claim 9 wherein the ski tote further includes a padded member mounted on and slidable along the long strap to cushion the weight of the skis on the user's shoulder.

* * * * *